United States Patent [19]

Nakamura et al.

[11] Patent Number: 4,715,478

[45] Date of Patent: Dec. 29, 1987

[54] HYDRAULIC ELEVATOR

[75] Inventors: Ichiro Nakamura, Katsuta; Satoshi Kobayashi, Yokohama; Eiichi Sasaki, Katsuta, all of Japan

[73] Assignee: Hitachi, Ltd., Tokyo, Japan

[21] Appl. No.: 928,327

[22] Filed: Nov. 7, 1986

[30] Foreign Application Priority Data

Nov. 25, 1985 [JP] Japan ..... 60-262414

[51] Int. Cl.[4] ..... B66B 1/26

[52] U.S. Cl. ..... 187/111; 187/134

[58] Field of Search ..... 187/110, 111, 134

[56] References Cited

U.S. PATENT DOCUMENTS 4,009,766 3/1977 Satoh ..... 187/134 X 4,434,874 3/1984 Caputo ..... 187/134 X 4,440,266 4/1984 Kohler ..... 187/134 X 4,593,792 6/1986 Yamamoto ..... 187/111

*Primary Examiner*—Charles D. Miller

*Assistant Examiner*—W. E. Duncanson, Jr.

*Attorney, Agent, or Firm*—Antonelli, Terry & Wands

[57] ABSTRACT

The velocity of a cage during a time interval from the start of deceleration to the stoppage of the cage is controlled by utilizing a velocity characteristic which changes depending upon the load condition or oil temperature of a hydraulic elevator, that is, a magnitude by which the velocity characteristic during the acceleration of the cage differs from a reference running characteristic. Thus, even when the load state or the oil temperature has changed, the operating period of time of the hydraulic elevator is shortened, so that a comfortable ride, energy saving, cost reduction etc. are attained.

5 Claims, 4 Drawing Figures

HYDRAULIC ELEVATOR

FIELD OF THE INVENTION AND RELATED ART STATEMENT

The present invention relates to a hydraulic elevator of the type wherein pressure oil to be supplied to or discharged from a hydraulic jack is controlled by a flow control valve and wherein a cage is raised or lowered directly or indirectly by the hydraulic jack.

As disclosed in U.S. Pat. No. 3,955,649 by way of example, a prior-art hydraulic elevator of the specified type controls the velocity of a cage in such a way that the flow of pressure oil to be supplied to or discharged from a hydraulic cylinder is controlled by a flow control valve. With this control method, the commands of deceleration start, stop etc. are issued upon detecting that the cage has passed predetermined positions, and the flow control valve having received them performs the flow control sequentially. This flow control is effected by employing a throttle and changing the open area of the throttle. The performance of the hydraulic elevator is accordingly determined by the flow control characteristic of the flow control valve and the method of controlling the flow control valve. Here, in the flow control with the throttle, a control flow Q is expressed by the following equation (1):

$$Q = C\,a\sqrt{\frac{2}{\rho}\,\Delta P} \qquad (1)$$

where a denotes the open area of the throttle, $\rho$ the density of the oil, $\Delta P$ the difference of pressure before and behind the throttle, and C a flow coefficient.

The control flow Q varies depending upon, not only the pressure difference $\Delta P$ before and behind the throttle, but also the temperature of the oil because the flow coefficient C is a function of the oil temperature. That is, the flow through the flow control valve, in turn, the velocity of the cage varies depending upon the load of the hydraulic elevator and the temperature of the oil. This signifies that, as illustrated in FIG. 4, even when the cage has been adjusted so as to run along a characteristic I under certain conditions, the characteristic I changes into a characteristic II or III under different operating conditions. The characteristic II corresponds to a case where the velocity lowers as a whole and where a floor arrival running time $t_s'$ during which the cage runs at a fixed low velocity becomes longer than an appropriate value $t_s$. The characteristic III corresponds to the reverse case where, on an extreme occasion, the floor arrival running time becomes null, and a stopping operation begins in the course of deceleration. Both are unpreferable characteristics for the hydraulic elevator. More specifically, in the case where the floor arrival running time during which the cage runs at the low velocity is long, the operating period of time of the elevator prolongs, and the passengers of the cage will think that the cage does not stop soon in spite of the deceleration thereof. Besides, in the ascending operation of the cage, energy loss, namely, heat generation increases to raise the oil temperature still more. In consequence, the velocity characteristic of the elevator further changes to lengthen the aforementioned operating period of time and spoil a comfortable ride and also to increase power consumption. Moreover, a cooling device for lowering the oil temperature in order to reduce the energy loss is required, which raises the cost of the elevator.

SUMMARY OF THE INVENTION

An object of the present invention is to provide a hydraulic elevator which can shorten an operating period of time to attain an enhanced comfortable ride.

Another object of the present invention is to provide a hydraulic elevator which can save energy.

Still another object of the present invention is to provide a hydraulic elevator which can reduce cost.

The objects are accomplished by comprising detection means to detect at least either of a velocity and a position of a cage, means to obtain an actual running velocity of the cage during acceleration thereof from a detected value of said detection means and to calculate a deviation between the actual running velocity and a predetermined reference running velocity, and means to determine a command velocity of the cage during deceleration thereof on the basis of the calculated result so as to bring a floor arrival running time close to a predetermined value.

DETAILED DESCRIPTION OF PREFERRED EMBODIMENTS

Figure 1:
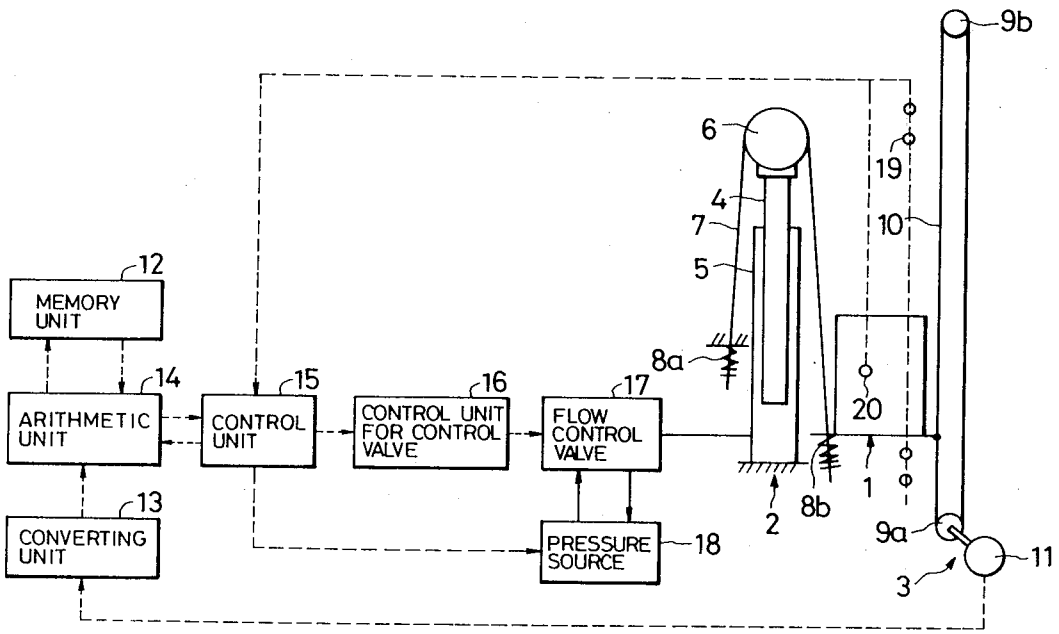
FIG. 1 is a schematic arrangement diagram showing an embodiment of a hydraulic elevator according to the present invention.

FIG. 1 is an arrangement diagram showing one embodiment of a hydraulic elevator according to the present invention.

A cage 1 is supported by a hydraulic jack 2 through a rope 7, springs 8a, 8b and a pulley 6. The cage 1 is raised or lowered by supplying pressure oil to or discharging it from the hydraulic jack 2 which is constructed of a cylinder 5 and a plunger 4. The flow of the pressure oil from a hydraulic pressure source 18 to be supplied to the hydraulic jack 2 is controlled by a flow control valve 17, while the flow of the pressure oil in the hydraulic jack 2 to be discharged is also controlled by the flow control valve 17. Numeral 3 designates a detection device for detecting the position or velocity of the cage 1. This detection device 3 is constructed of pulleys 9a and 9b which are juxtaposed in the running direction of the cage 1 within a hoistway, a rope 10 which is extended across both the pulleys 9a, 9b and which is fixed to the cage 1, and a detector 11 such as an encoder. With the detection device 3, the pulley 9a is driven by the running of the cage 1, and the rotating velocity or rotational angle thereof is detected by the detector 11 such as an encoder.

A memory unit 12 stores beforehand the reference running velocities at which the cage 1 ought to run, and the values of constants and variables necessary for various calculations. A converting unit 13 converts the analog signal or pulse train signal of the velocity or position of the cage 1 from the detection device 3, into a digital signal and delivers the latter signal to an arithmetic unit 14. On the basis of the information items stored in the memory unit 12, the data from the converting unit 13 and a command from a control unit 15, the arithmetic unit 14 calculates the load condition and operating conditions of the elevator being currently operated and provides a command for operating the elevator henceforth. The control unit 15 delivers necessary data and commands to the hydraulic pressure source 18 and a control unit 16 for the control valve 17 on the basis of commands from a pushbutton 20 in the cage 1, a call button in a hall, switches 19 in the hoistway and the arithmetic unit 14, thereby to supervise the whole operation of the elevator. The valve control unit 16 controls the flow control valve 17 on the basis of the command from the control unit 15.

Next, the operations of the hydraulic elevator of the present invention will be described.

In case of raising the cage 1, the constant-volume hydraulic pump of the hydraulic pressure source 18 is driven at a fixed revolution number so as to supply a ( fixed flow of pressure oil to the flow control valve 17. The flow control valve 17 bleeds off the surplus pressure oil developing in such a manner that a necessary flow to be supplied to the hydraulic jack 2 is subtracted from the supplied flow. Accordingly, when the load of the hydraulic elevator increases to enlarge the pressure difference $\Delta P$ before and behind the throttle or the oil temperature rises to enlarge the flow coefficient C, the bleed-off flow increases according to Eq. (1) mentioned before, and the flow to be supplied to the hydraulic jack 2 decreases. That is, the state of the characteristic I changes into that of the characteristic II in FIG. 4.

On the other hand, in case of lowering the cage 1, the pressure oil to be discharged from the hydraulic jack 2 is controlled by the flow control valve 17. Therefore, when the differential pressure $\Delta P$ or the flow coefficient C enlarges, the flow of of discharge from the hydraulic jack 2 increases, and the velocity of the cage 1 changes from the state of the characteristic I shown in FIG. 4 into the state of the characteristic III.

As understood from Eq. (1), the rate of the change of the velocity characteristic of the cage 1 can be presumed from the differential pressure $\Delta P$ and the oil temperature T. To the contrary, when the velocity of the cage 1 is found, the combined influence of the differential pressure $\Delta P$ and the oil temperatue T can be presumed through the influences thereof are difficult to be separately presumed. In thr hydraulic elevatorof the present invention, therefore, the velocity control of the cage is performed as stated below.

Figure 4:
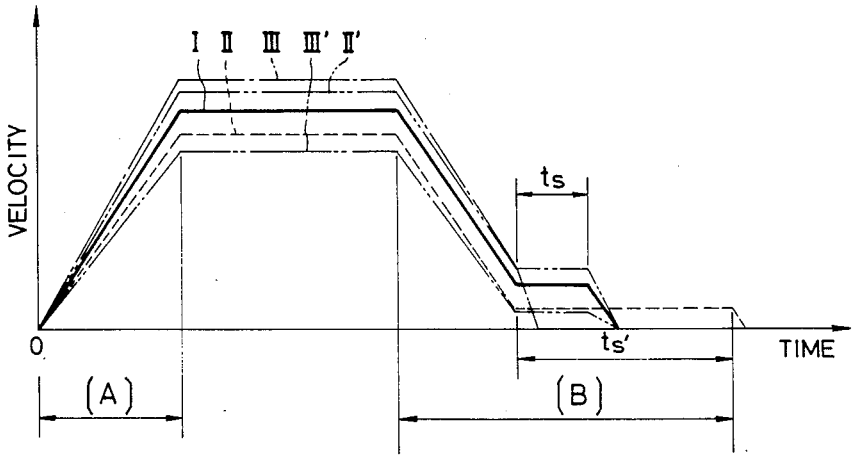
FIG. 4 is a diagram for explaining the velocity characteristics of hydraulic elevators.

The actual running velocity of the cage in the case where the hydraulic elevator is operated along a reference running pattern $V_s$ stored in the memory unit 12, under a certain condition I is assumed the characteristic I shown in FIG. 4 and is denoted by $V_I$. The actual running velocity in the case of operating the elevator under another condition II is assumed the characteristic II shown in FIG. 4, and this velocity $V_I'$ is assumed a velocity $V_{II}$ by way of example. In the present invention, the difference of the velocities $V_I$ and $V_{II}$ in the acceleration period [A] of the hydraulic elevator is used for correcting an operating velocity command in a period [B] from the start of deceleration of the cage to the stoppage thereof.

More specifically, a command velocity $V_s'$ for operating the hydraulic elevator is calculated and obtained:

$$V_s' = V_s + (V_I - V_{II}) \quad (2)$$

On this occasion, during the period [A], the detected signal from the detection device 3 is sent to the arithmetic unit 14 via the converting unit 13. While comparing the reference running pattern $V_s$ stored in the memory unit 12 beforehand and the difference of the running velocities ($V_I$-$V_{II}$), the arithmetic unit 14 stores the relationship between $V_s$ and ($V_I$-$V_{II}$) in the memory unit 12.

During the period [B], the arithmetic unit 14 calculates the command velocity $V_s'$ from the stored data items $V_s$ and ($V_I$- $V_{II}$) and sends the control unit 15 a signal corresponding to this command velocity $V_s'$. The control unit 15 sends the command from the arithmetic unit 14, to the valve control unit 16, which actually controls the flow control valve 17.

As described above, in the present invention, when the actual running velocity $V_1'$, for example, $V_{II}$ in the acceleration period [A]is detected, the velocity command $V_s'$ for the deceleration period [B] from the start of deceleration to the stoppage is calculated as the velocity $V_{II}'$ of a characteristic $V_{II}'$ in FIG. 4 by the arithmetic unit 14, whereupon the actual running velocity is controlled from $V_{II}$ to $V_I$.

Needless to say, in a case where the actual running velocity in the acceleration period [A] is the velocity $V_{III}$ of the characteristic III, the velocity command $V_s'$ for the deceleration period [B] is calculated as the velocity $V_{III}'$ of a characteristic III', and the actual running velocity is controlled from $V_{III}$ to $V_I$.

The flow control valve 17 needs to be a control valve which can control the flow while following the magnitude of the command.

Figure 2:
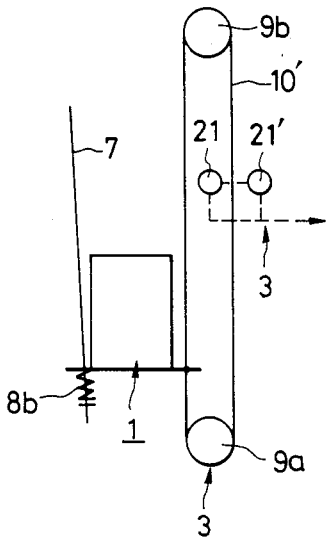
FIGS. 2 and 3 are views each showing another embodiment of a detection device in the hydraulic elevator of the present invention.

FIG. 2 shows another embodiment of the detection device in the hydraulic elevator of the present invention. Although the pulleys 9*a* and 9*b* are arranged in the same manner as in the foregoing, a perforated tape 10' is extended across both the pulleys, and a light source 21' such as light emitting diode and a photosensor 21 such as phototransistor are opposed with the tape 10' held therebetween. As the cage 1 runs, the light beam of the light source 21' is transmitted and intercepted by the tape 10', and the transmission and interception are derived as a pulse train signal by the photosensor 21. Thus, the position or velocity of the cage 1 is detected.

Figure 3:
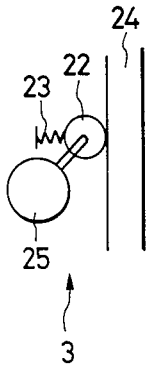

FIG. 3 shows still another embodiment of the detection device in the hydraulic elevator of the present invention. A roller 22 mounted on the cage 1 is urged against the guide rail 24 of the cage 1 by a spring 23, the running of the cage 1 is converted into the rotation of the roller 22, and the rotation is detected by a detector 25 such as tacho-generator.

According to the present invention, even when the load condition or the oil temperature has changed during the operation of the elevator, the operating period of time of the elevator is shortened. Therefore, a comfortable ride is provided for passengers. Moreover, energy can be saved owing to reduction in energy loss, and cost can be curtailed.

What is claimed is:

1. In a hydraulic elevator of the type which has a cage, a hydraulic jack, a hydraulic pressure source, a flow control valve and a control device, and in which a flow of a pressure fluid to be supplied to or discharged from the hydraulic jack is controlled thereby to raise or lower the cage directly or indirectly, the hydraulic elevator comprising:

detection means for obtaining an actual running velocity of the cage during acceleration, memory means for storing a predetermined reference running velocity, arithmetic means for calculating a command velocity during deceleration from said reference running velocity and the difference between said actual running velocity and a running velocity under a reference operating condition, and drive means driven in response to said command velocity so as to cause the cage to have a floor arrival running time close to a predetermined value.

2. A hydraulic elevator as defined in claim 1, wherein said detection means comprises pulleys which are disposed on upper and lower sides within a hoistway in a running direction of the cage, a rope which is extended across said pulleys and a part of which is fixed to the case, and a detector which detects a movement value of said rope.

3. A hydraulic elevator as defined in claim 1, wherein said detection means comprises pulleys which are disposed on upper and lower sides within a hoistway in a running direction of the cage, a perforated tape which is extended across said pulleys and a part of which is fixed to the cage, and a light source and a photosensor which are disposed with said perforated tape held therebetween.

4. A hydraulic elevator as defined in claim 1 wherein said detection means comprises a roller which is mounted on the cage, a spring which urges said roller against a guide rail of the cage, and a detector which detects rotation of said roller.

5. In a hydraulic elevator of the type which has a cage, a hydraulic jack, a hydraulic pressure source, a flow control valve and a control device, and in which a flow of a pressure fluid to be supplied to or discharged from the hydraulic jack is controlled thereby to raise or lower the cage directly or indirectly; a hydraulic elevator characterized by comprising detection means to detect at least either of a velocity and a position of the cage, means to obtain an actual running velocity of the cage during acceleration thereof from a detected value of said detection means to calculate a deviation between the actual running velocity and a predetermined reference running velocity and means to determine a command velocity of the cage during deceleration thereof on the basis of the calculated result so as to bring a floor arrival running time close to a predetermined value, wherein the reference running velocity $V_s$ is stored beforehand, a running velocity $V_1$ under a reference operating condition and the actual running velocity $V_1'$ during the acceleration in the running of the cage are detected, and the command velocity $V_s'$ during the deceleration is calculated according to an equation of $V_s' = V_s + (V_1 - V_1')$.

* * * * *